US006988875B2

(12) United States Patent
Shintoku et al.

(10) Patent No.: US 6,988,875 B2
(45) Date of Patent: Jan. 24, 2006

(54) LUBRICATING STRUCTURE IN FIXED DISPLACEMENT PISTON TYPE COMPRESSOR

(75) Inventors: Noriyuki Shintoku, Kariya (JP); Shinichi Sato, Kariya (JP); Akio Saiki, Kariya (JP); Nobutoshi Banno, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/310,525

(22) Filed: Dec. 5, 2002

(65) Prior Publication Data

US 2003/0108436 A1 Jun. 12, 2003

(30) Foreign Application Priority Data

Dec. 6, 2001 (JP) ..... 2001-373137

(51) Int. Cl.
*F01B 13/04* (2006.01)
*F04B 1/12* (2006.01)

(52) U.S. Cl. ..... 417/269; 92/12.2; 184/6.17

(58) Field of Classification Search ..... 417/269, 417/270, 222.1, 222.2, 254; 92/12.2; 91/480, 91/499; 137/615.4; 184/6.16, 6.17
See application file for complete search history.

(56) References Cited

U.S. PATENT DOCUMENTS

| | | | | |
|---|---|---|---|---|
| 4,444,549 | A | 4/1984 | Takahashi et al. | 417/269 |
| 5,419,685 | A | 5/1995 | Fujii et al. | 417/269 |
| 5,765,996 | A | 6/1998 | Fujii et al. | 417/269 |
| 6,231,314 | B1 | 5/2001 | Murakami et al. | 417/222.1 |

FOREIGN PATENT DOCUMENTS

| | | |
|---|---|---|
| JP | 05-231309 | 9/1993 |
| JP | 05-312145 | 11/1993 |
| JP | 07-063165 | 3/1995 |
| JP | 07063165 A | 3/1995 |

*Primary Examiner*—Charles G. Freay
(74) *Attorney, Agent, or Firm*—Morgan & Finnegan, LLP

(57) ABSTRACT

A lubricating structure in a fixed displacement piston type compressor has a housing, a rotary shaft, a cam, a piston, a rotary valve and a rotary body. The housing defines a cam chamber, cylinder bores and a suction pressure region. The rotary shaft is rotatably supported by the housing. The cam is located in the cam chamber and is connected to the rotary shaft. The piston is located in each of the cylinder bores and engages the cam to reciprocate with rotation of the rotary shaft through the cam. The rotary valve connected to the rotary shaft includes an introducing passage and a supply passage that interconnects the introducing passage and the suction pressure region. The introducing passage introduces fluid into the cylinder bores through the supply passage. The rotary body connected to the rotary shaft includes a communication passage that interconnects the cam chamber and the suction pressure region.

20 Claims, 7 Drawing Sheets

LUBRICATING STRUCTURE IN FIXED DISPLACEMENT PISTON TYPE COMPRESSOR

BACKGROUND OF THE INVENTION

The present invention relates to a lubricating structure in a fixed displacement piston type compressor with a rotary valve that introduces fluid from a suction pressure region into a compression chamber in accordance with its rotation.

A piston type compressor disclosed in Unexamined Japanese Patent Publication No. 7-63165 employs a rotary valve for introducing refrigerant into a compression chamber defined in a cylinder bore. A double-headed piston in the compressor reciprocates by the rotation of a swash plate. In this fixed displacement swash plate type compressor, a rotary shaft itself functions as the rotary valve. In comparison to a flapper suction valve that opens and closes a suction port for introducing refrigerant into the compression chamber, a rotary valve improves volumetric efficiency.

The refrigerant containing lubricant oil in the compression chamber leaks through a gap between the piston and the inner circumferential surface of the cylinder bore into a crank chamber that accommodates the swash plate. An unwanted feature is that the refrigerant leaked into the crank chamber flows out to a suction pressure region along the circumferential surface of the rotary shaft. As a result, the lubricant oil in the crank chamber also flows out to the suction pressure region. Meanwhile, a shoe slides on the swash plate in the crank chamber to transmit the power of the swash plate to the piston so that the sliding portion needs to be lubricated. However, since the lubricant oil together with the refrigerant in the crank chamber flows out to the suction pressure region along the circumferential surface of the rotary shaft, the crank chamber cannot ensure the sufficient amount of lubricant oil. Therefore, it is desired that lubricating performance is improved in a fixed displacement piston type compressor with a rotary valve.

SUMMARY OF THE INVENTION

In accordance with the present invention, a lubricating structure in a fixed displacement piston type compressor has a housing, a rotary shaft, a cam, a piston and a rotary body. The housing defines a cam chamber, a plurality of cylinder bores and a suction pressure region. The rotary shaft is rotatably supported by the housing. The cam is located in the cam chamber and is connected to the rotary shaft. The piston is located in each of the cylinder bores and engages the cam to reciprocate in accordance with rotation of the rotary shaft through the cam. The rotary valve is connected to the rotary shaft and includes an introducing passage and a supply passage that interconnects the introducing passage and the suction pressure region. The introducing passage introduces fluid into the cylinder bores through the supply passage. The rotary body is connected to the rotary shaft and includes a communication passage that interconnects the cam chamber and the suction pressure region.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first preferred embodiment of the present invention will now be described in reference to FIGS. 1A through 3.

Figures 1A, 1B:
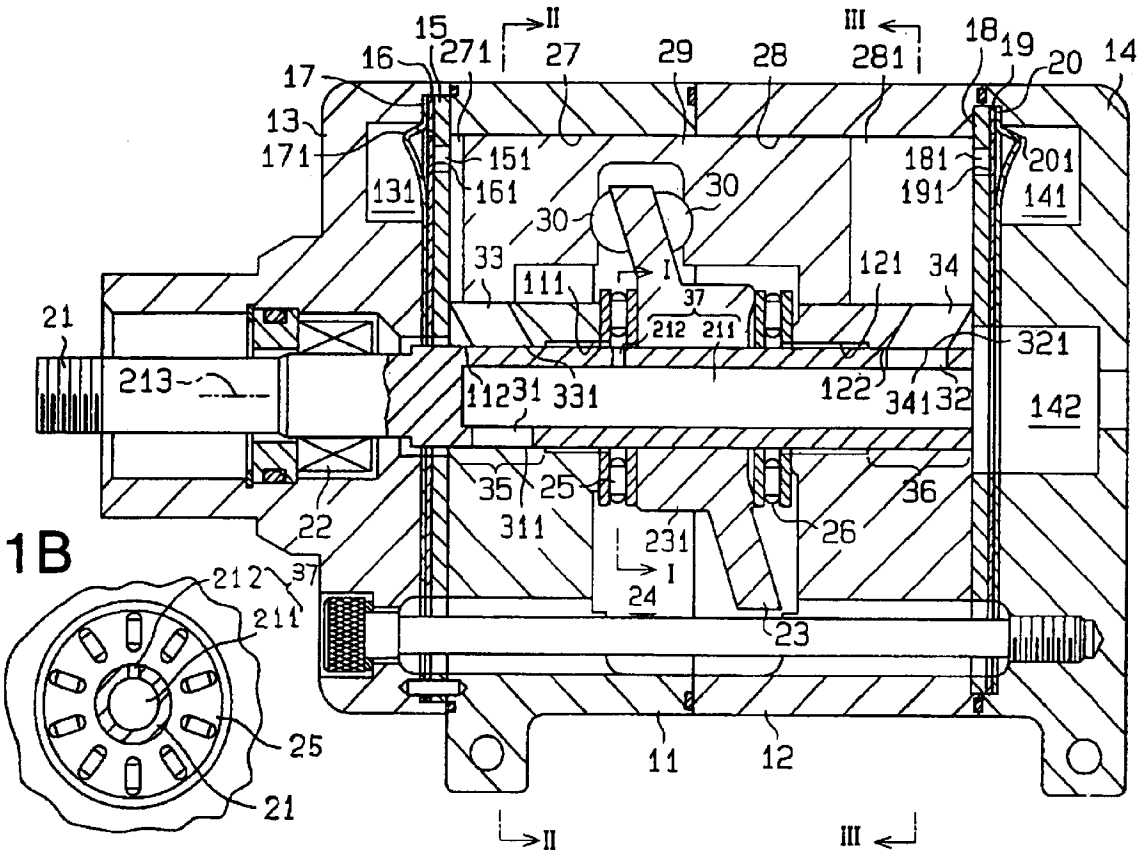
FIG. 1A is a longitudinal cross-sectional view of a fixed displacement double-headed piston type compressor according to a first preferred embodiment of the present invention.
FIG. 1B is a cross-sectional view that is taken along the line I—I in FIG. 1A.

Now referring to FIG. 1A, a diagram illustrates a longitudinal cross-sectional view of a fixed displacement double-headed piston type compressor according to the first preferred embodiment of the present invention. The front side and the rear side of the compressor respectively correspond to the left side and the right side in the drawing. A housing of the compressor includes a pair of front and rear cylinder blocks 11, 12, a front housing 13 and a rear housing 14. The front cylinder block 11 is connected to the rear cylinder block 12. The front housing 13 is connected to the front cylinder block 11. The rear housing 14 is connected to the rear cylinder block 12. A discharge chamber or a discharge pressure region 131 is defined in the front housing 13. A discharge chamber or a discharge pressure region 141 and a suction chamber or a suction pressure region 142 are defined in the rear housing 14.

A valve port plate 15, a valve plate 16 and a retainer plate 17 are interposed between the front cylinder block 11 and the front housing 13. A valve port plate 18, a valve plate 19 and a retainer plate 20 are interposed between the rear cylinder block 12 and the rear housing 14. Discharge ports 151 and 181 are respectively formed in the valve port plates 15 and 18. Discharge valves 161 and 191 are respectively formed in the valve plates 16 and 19 to open and close the respective discharge ports 151 and 181. Retainer 171 and 201 are respectively formed in the retainer plate 17 and 20 to regulate the respective opening degrees of the discharge valves 161 and 191.

A rotary shaft 21 is rotatably supported by the front and rear cylinder blocks 11, 12 and is inserted into shaft holes 111 and 121 that extend through the front and rear cylinder blocks 11, 12. Namely, the rotary shaft 21 is directly supported by the front and rear cylinder blocks 11, 12 through the respective shaft holes 111 and 121. A shaft seal member 22 is interposed between the front housing 13 and the rotary shaft 21. A swash plate or a cam 23 is secured to the rotary shaft 21 and is located in a crank chamber or a cam chamber 24 that is defined between the front and rear cylinder blocks 11, 12. A thrust bearing 25 is interposed between a rear end surface of the cylinder block 11 and an annular proximal portion 231 of the swash plate 23. A thrust bearing 26 is interposed between a front end surface of the cylinder block 12 and the annular proximal portion 231 of the swash plate 23. The thrust bearings 25 and 26 sandwich the swash plate 23 to regulate a position of the rotary shaft 21 in a direction of an axis 213 of the rotary shaft 21.

A plurality of front cylinder bores 27 (only one front cylinder bore 27 is shown in the drawing) is formed in the front cylinder block 11. Similarly, a plurality of rear cylinder bores 28 (only one rear cylinder bore 28 is shown in the drawing) is formed in the rear cylinder block 12. Front and rear heads of a double-headed piston 29 are respectively located in the pair of cylinder bores 27, 28. The double-headed piston 29 engages the swash plate 23 through a pair of shoes. The swash plate 23 integrally rotates with the rotary shaft 21 and transmits the power of the swash plate 23 to the doubled-headed piston 29 through the shoes 30 so that the double-headed piston 29 reciprocates in the pair of cylinder bores 27, 28. Compression chambers 271 and 281 are defined in the respective cylinder bores 27 and 28.

Sealing portions 112 and 122 are respectively provided at the inner circumferential surfaces of the shaft holes 111 and 121. The sealing portions 112 and 122 are smaller in diameter than the rest of the inner circumferential surfaces of the shaft holes 111 and 121. In other words, the rotary shaft 21 is directly supported by the cylinder blocks 11 and 12 through the respective sealing portions 112 and 122. A supply passage 211 is formed in the rotary shaft 21. The supply passage 211 extends to the rear end of the rotary shaft 21 and communicates with the suction chamber 142 in the rear housing 14. Introducing passages 31 and 32 are formed in the rotary shaft 21 so as to communicate with the suction chamber 142 through the supply passage 211.

A suction passage 33 is formed in the front cylinder block 11 so as to interconnect the cylinder bore 27 and the shaft hole 111. An inlet 331 of the suction passage 33 opens on the sealing portion 112. Similarly, a suction passage 34 is formed in the rear cylinder block 12 so as to interconnect the cylinder bore 28 and the shaft hole 121. An inlet 341 of the suction passage 34 opens on the sealing portion 122. As the rotary shaft 21 rotates, an outlet 311 of the introducing passage 31 intermittently communicates with the inlet 331 of the suction passage 33. Likewise, as the rotary shaft 21 rotates, an outlet 321 of the introducing passage 32 intermittently communicates with the inlet 341 of the suction passage 34.

When the front cylinder bore 27 is in a suction cycle, that is, when the double-headed piston 29 moves from the left side to the right side in FIG. 1A, the outlet 311 communicates with the inlet 331 of suction passage 33. As a result, refrigerant in the supply passage 211 is introduced into the compression chamber 271 through the introducing passage 31 and the suction passage 33. When the front cylinder bore 27 is in a discharge cycle, that is, when the double-headed piston 29 moves from the right side to the left side in FIG. 1A, the outlet 311 is disconnected from the inlet 331 of the suction passage 33. As a result, refrigerant in the compression chamber 271 is discharged to the discharge chamber 131 through the discharge port 151 by pushing the discharge valve 161. The refrigerant discharged to the discharge chamber 131 flows out to an external refrigerant circuit, which is not shown in the drawing.

Similarly, when the rear cylinder bore 28 is in a suction cycle, that is, when the double-headed piston 29 moves from the right side to the left side in FIG. 1A, the outlet 321 communicates with the inlet 341 of suction passage 34. As a result, refrigerant in the supply passage 211 of the rotary shaft 21 is introduced into the compression chamber 281 through the introducing passage 32 and the suction passage 34. When the rear cylinder bore 28 is in a discharge cycle, that is, when the double-headed piston 29 moves from the left side to the right side in FIG. 1A, the outlet 321 is disconnected from the inlet 341 of the suction passage 34. As a result, refrigerant in the compression chamber 281 is discharged to the discharge chamber 141 through the discharge port 181 by pushing the discharge valve 191. The refrigerant discharged to the discharge chamber 141 flows out to the external refrigerant circuit. The refrigerant flowing out to the external refrigerant circuit returns to the suction chamber 142.

Rotary valves 35 and 36 are integrated with the rotary shaft 21 and are surrounded by the sealing portions 112 and 122. A communication passage 37 includes a communication hole 212 and the supply passage 211 and interconnects the crank chamber 24 and the suction chamber 142. The communication hole 212 is formed in the circumferential surface of the rotary shaft 21 to face the thrust bearing 25. The communication hole 212 interconnects the supply passage 211 and the crank chamber 24.

Now referring to FIG. 1B, a diagram illustrates a cross-sectional view that is taken along the line I—I in FIG. 1A. The communication hole 212 is located near the thrust bearing 25 and extends substantially in a radial direction of the rotary shaft 21. As the rotary shaft 21 rotates, the communication hole 212 orbits along the inner circumference of the thrust bearing 25. As a result, the communication hole 212 contributes to lubricating substantially the entire portion of the thrust bearing 25.

Figure 2:
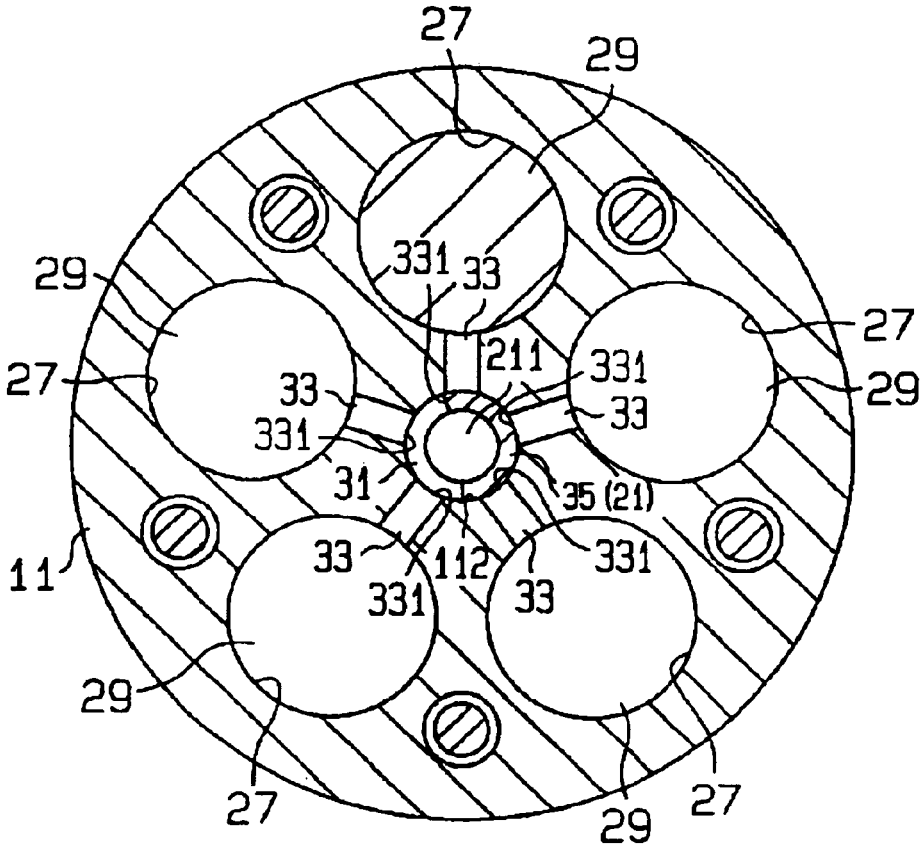
FIG. 2 is a cross-sectional view that is taken along the line II—II in FIG. 1A.

Now referring to FIG. 2, a diagram illustrates a cross-sectional view that is taken along the line II—II in FIG. 1A. The plurality of front cylinder bores 27 is formed in the front cylinder block 11 and is aligned around the rotary shaft 21. Each of the front cylinder bores 27 accommodates the double-headed piston 29 and communicates with the suction passage 33. Meanwhile, the rotary shaft 21 includes the supply passage 211 and the introducing passage 31 that communicates with the supply passage 211. As the rotary shaft 21 rotates, the introducing passage 31 intermittently communicates with the suction passage 33 for introducing the refrigerant into the front cylinder bore 27. Thus, the rotary shaft 21 functions as the rotary valve 35.

Figure 3:
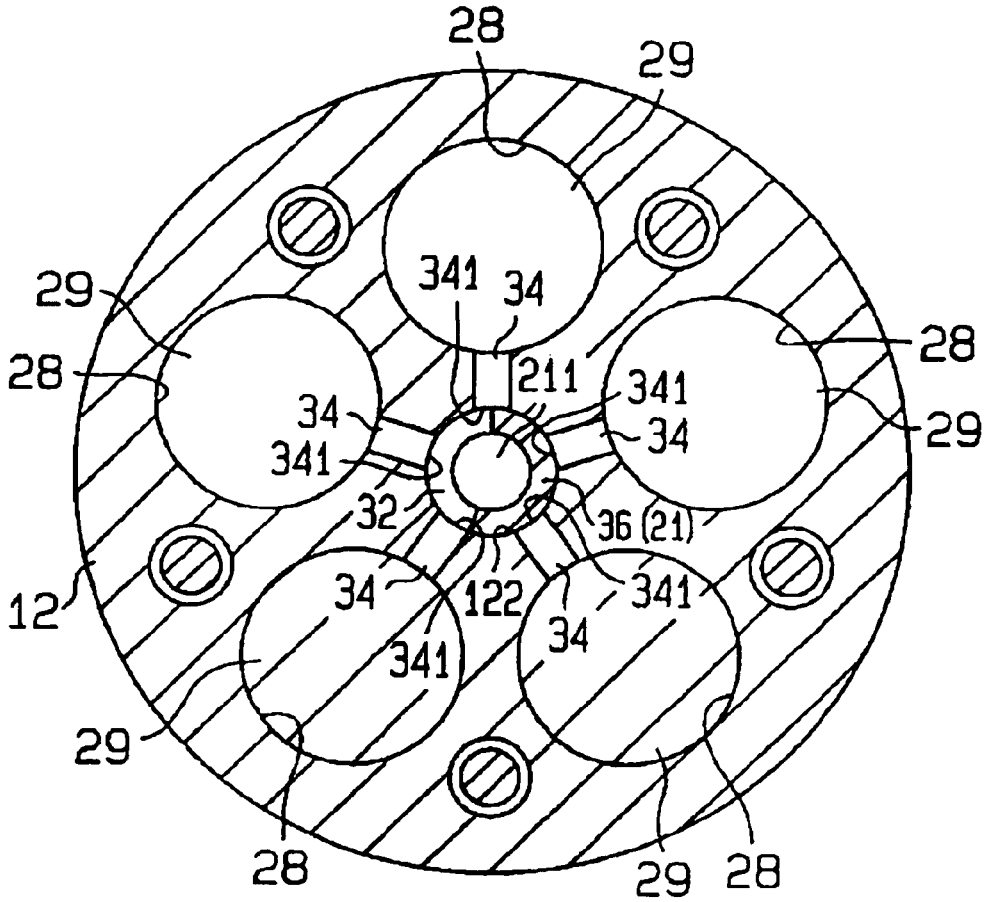
FIG. 3 is a cross-sectional view that is taken along the line III—III in FIG. 1A.

Now referring to FIG. 3, a diagram illustrates a cross-sectional view that is taken along the line III—III in FIG. 1A. The plurality of rear cylinder bores 28 is formed in the rear cylinder block 12 and is aligned around the rotary shaft 21. Each of the rear cylinder bores 28 accommodates the double-headed piston 29 and communicates with the suction passage 34. Meanwhile, the rotary shaft 21 includes the supply passage 211 and the introducing passage 32 that communicates with the supply passage 211. As the rotary shaft 21 rotates, the introducing passage 32 intermittently communicates with the suction passage 34 for introducing the refrigerant into the rear cylinder bore 28. Thus, the rotary shaft 21 functions as the rotary valve 36.

According to the first preferred embodiment, the following advantageous effects are obtained.

(1-1) The part of refrigerant in the compression chambers 271 and 281 respectively leaks through a gap between the inner circumferential surfaces of the cylinder bores 27, 28 and the outer circumferential surface of the double-headed piston 29. The lubricant oil in the refrigerant also leaks from the compression chambers 271, 281 to the crank chamber 24. Meanwhile, the communication hole 212 orbits around the axis 213 of the rotary shaft 21 as the rotary shaft 21 rotates. The gaseous refrigerant in the crank chamber 24 mainly flows out to the supply passage 211 through the communication hole 212. On the other hand, the liquid lubricant oil in the refrigerant substantially does not enter into the orbiting communication hole 212. Therefore, the part of lubricant oil in the refrigerant is separated from the gaseous refrigerant that flows out to the supply passage 211. The separated lubricant oil contributes to lubricating a required lubricating portion, such as a sliding portion between the swash plate 23 and the shoe 30, in the crank chamber 24, thus improving lubricating performance in the compressor.

According to an experiment, the amount of lubricant oil in the crank chamber 24 is approximately 10 ml in a conventional compressor when the compressor is running. On the other hand, the amount of lubricant oil in the crank chamber 24 is increased to approximately 60 ml in a compressor with the communication hole 212 when the compressor is running.

(1-2) The supply passage 211 sends the refrigerant to the introducing passages 31, 32 of the respective rotary valve 35, 36 and constitutes a portion of the communication passage 37. A new formed passage for communication is to only form the communication hole 212. Accordingly, It is simple for forming the communication passage 37.

(1-3) The communication hole 212 of the communication passage 37 is located near the thrust bearing 25, and the gaseous refrigerant flows from the crank chamber 24 to the communication passage 37. The flow of refrigerant guides the lubricant oil toward the thrust bearing 25. The part of guided lubricant oil contributes to lubricating the thrust bearing 25.

(1-4) The rotary valves 35, 36 are integrated with the rotary shaft 21 in the first preferred embodiment. In comparison to a structure that separately includes rotary valves from a rotary shaft, the number of components is reduced and an assembling process of the compressor is simple in the first preferred embodiment.

A second preferred embodiment of the present invention will now be described in reference to FIGS. 4 through 6. The same reference numerals denote the identical components to those in the first preferred embodiment.

Figure 4:
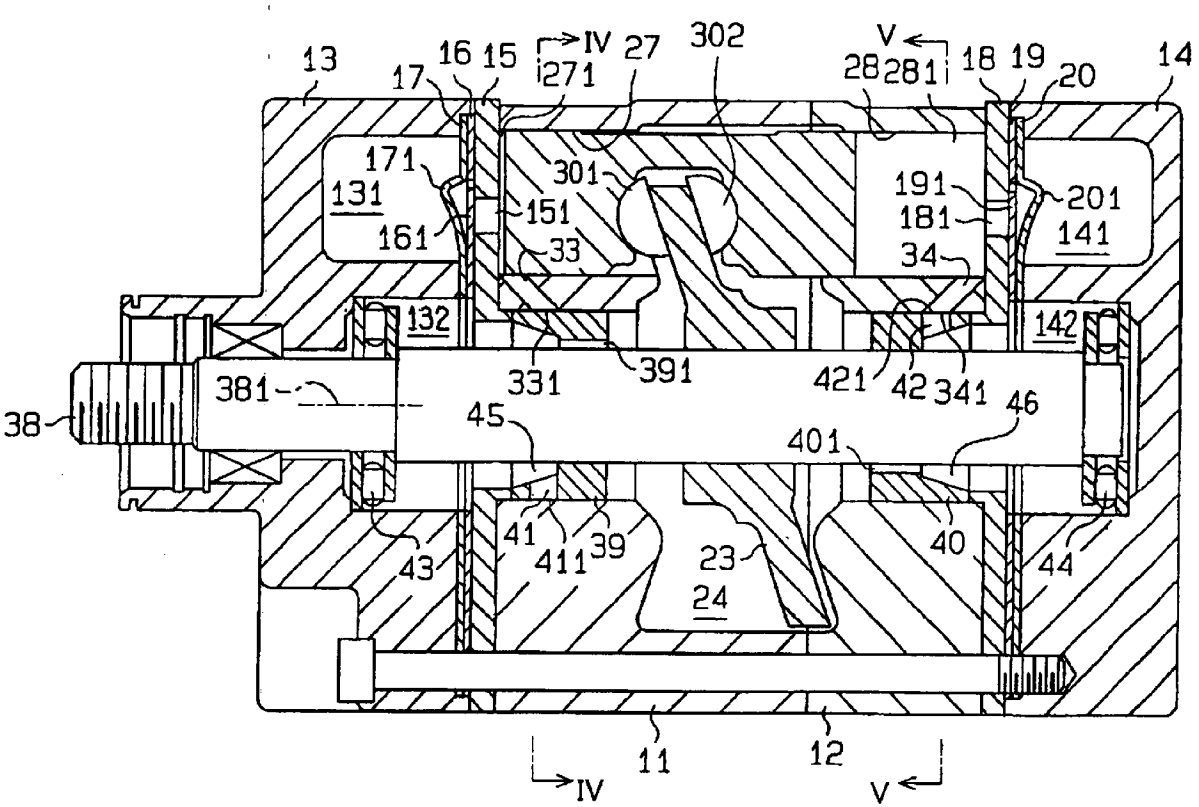
FIG. 4 is a longitudinal cross-sectional view of a fixed displacement double-headed piston type compressor according to a second preferred embodiment of the present invention.

Now referring to FIG. 4, a diagram illustrates a longitudinal cross-sectional view of a fixed displacement double-headed piston type compressor according to the second preferred embodiment of the present invention. Rotary valves 39 and 40 are secured to a rotary shaft 38. A pair of thrust bearings 43 and 44 regulates a position of the rotary shaft 38 in a direction of an axis 381 of the rotary shaft 38. Introducing passages 41, 42 formed in the respective rotary valves 39, 40 communicate with the crank chamber 24. An outlet 411 of the introducing passage 41 intermittently communicates with the inlet of the suction passage 33 as the rotary valve 39 rotates. Likewise, an outlet 421 of the introducing passage 42 intermittently communicates with the inlet of the suction passage 34 as the rotary valve 40 rotates. The refrigerant in a suction chamber 132 defined in the front housing 13 is introduced into the compression chamber 271 in a suction cycle through a supply passage 45, the introducing passage 41 and the suction passage 33. Similarly, the refrigerant in the suction chamber 142 defined in the rear housing 14 is introduced into the compression chamber 281 in a suction cycle through a supply passage 46, the introducing passage 42 and the suction passage 34.

Communication passages 391 and 401 are respectively formed in the inner circumferential surface of the rotary valves 39 and 40 and extend substantially in the direction of the axis 381 of the rotary shaft 38. The communication passage 391 interconnects the suction chamber or the suction pressure region 132 and the crank chamber 24. Similarly, the communication passage 401 interconnects the suction chamber or the suction pressure region 142 and the crank chamber 24. The crank chamber 24 communicates with the suction chambers or the suction pressure regions 132, 142 only through the respective communication passages 391, 401 and the respective supply passages 45, 46. The communication passages 391, 401 are formed in the respective rotary valves or the rotary bodies 39, 40 that integrally rotate with the rotary shaft 38 and function as well as the communication passage 37 in the first preferred embodiment.

Figure 5:
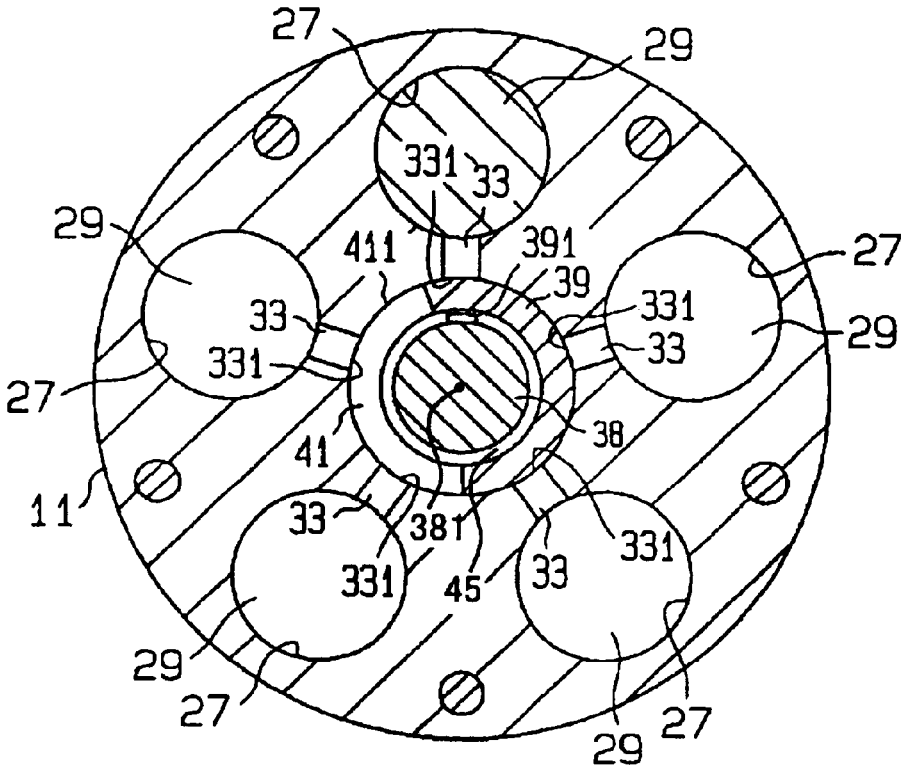
FIG. 5 is a cross-sectional view that is taken along the line IV—IV in FIG. 4.

Now referring to FIG. 5, a diagram illustrates a cross-sectional view that is taken along the line IV—IV in FIG. 4. The plurality of front cylinder bores 27 is formed in the front cylinder block 11 and is aligned around the rotary shaft 38. Each of the front cylinder bores 27 accommodates the double-headed piston 29 and communicates with the suction passage 33. Meanwhile, the rotary valve 39 is connected to the rotary shaft 38 so as to rotate integrally with. The rotary valve 39 includes the supply passage 45 and the introducing passage 41 that communicates with the supply passage 45. As the rotary shaft 38 rotates, the introducing passage 41 intermittently communicates with the suction passage 33 for introducing the refrigerant into the front cylinder bore 27, and the communication passage 391 orbits around the axis 381 of the rotary shaft 38.

Figure 6:
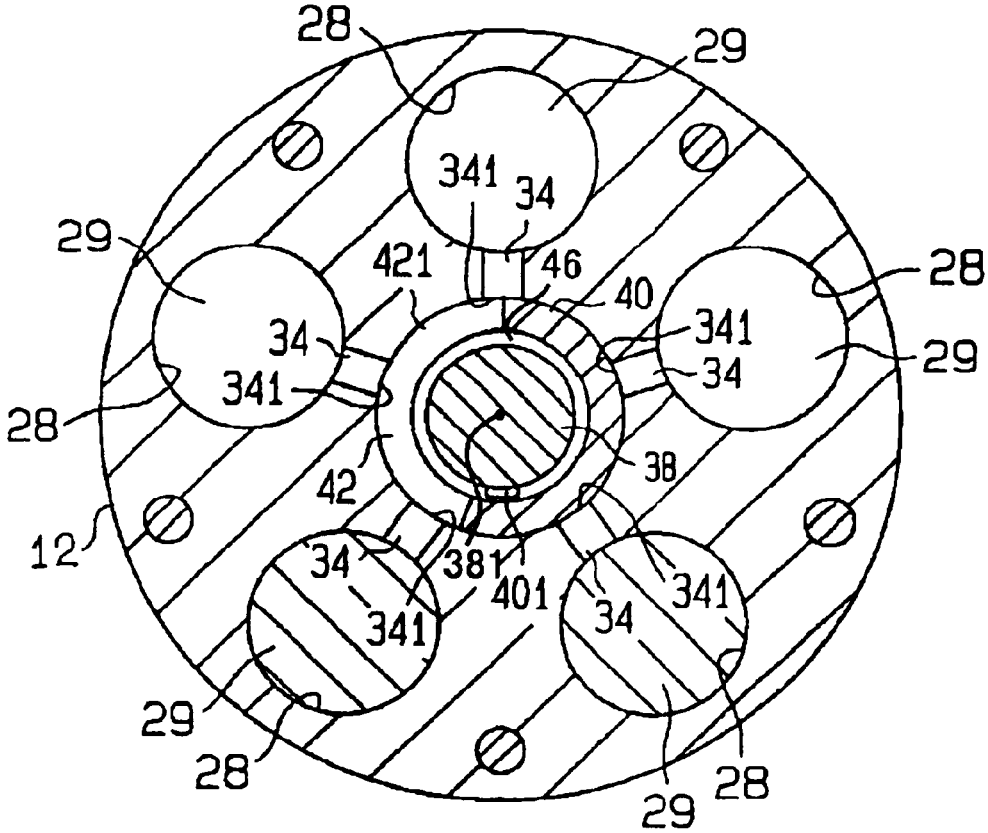
FIG. 6 is a cross-sectional view that is taken along the line V—V in FIG. 4.

Now referring to FIG. 6, a diagram illustrates a cross-sectional view that is taken along the line V—V in FIG. 4. The plurality of rear cylinder bores 28 is formed in the rear cylinder block 12 and is aligned around the rotary shaft 38. Each of the rear cylinder bores 28 accommodates the double-headed piston 29 and communicates with the suction passage 34. Meanwhile, the rotary valve 40 is connected to the rotary shaft 38 so as to rotate integrally with. The rotary valve 40 includes the supply passage 46 and the introducing passage 42 that communicates with the supply passage 46. As the rotary shaft 38 rotates, the introducing passage 42 intermittently communicates with the suction passage 34 for introducing the refrigerant into the rear cylinder bore 28, and the communication passage 401 orbits around the axis 381 of the rotary shaft 38.

According to the second preferred embodiment, the advantageous effect as well as the paragraph (1-1) in the first preferred embodiment is obtained.

The present invention is not limited to the above-described embodiments, but may be modified into the following alternative embodiments.

Figure 7:
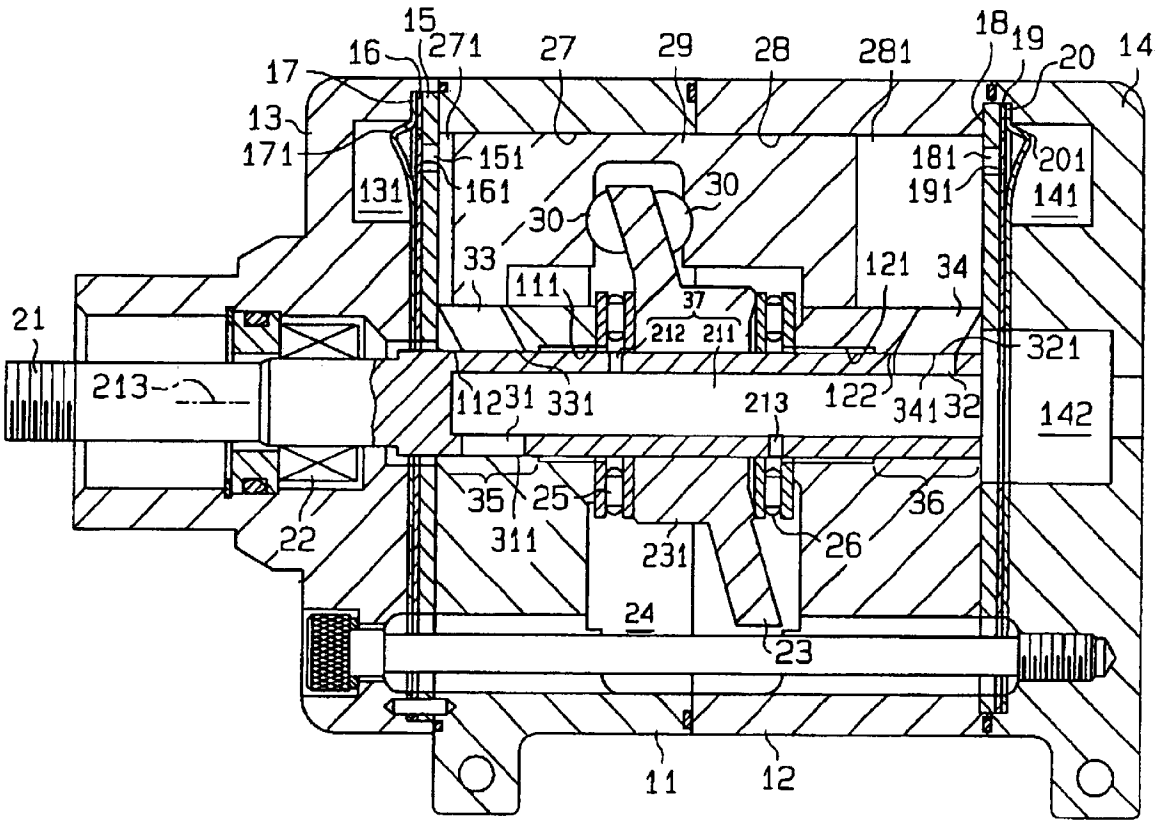
FIG. 7 is a longitudinal cross-sectional view of a fixed displacement double-headed piston type compressor according to an alternative embodiment.

In alternative embodiments to the above first preferred embodiment, referring to FIG. 7, a second communication hole 213 that is substantially identical to the communication hole 212 is formed in a portion of the outer circumferential surface of the rotary shaft 21 in such a manner that the second communication hole 213 faces the thrust bearing 26. Thus, lubricating performance is improved on the thrust bearing 26.

In alternative embodiments to the above preferred embodiments, a fixed displacement single-headed piston type compressor is employed.

In alternative embodiments to the above preferred embodiments, a piston type compressor that has a cam in a predetermined shape other than a swash plate is employed.

Therefore, the present examples and embodiments are to be considered as illustrative and not restrictive, and the invention is not to be limited to the details given herein but may be modified within the scope of the appended claims.

What is claimed is:

1. A lubricating structure in a fixed displacement piston type compressor, comprising:

a housing defining a cam chamber, a plurality of cylinder bores and a suction pressure region;

a rotary shaft rotatably supported by the housing;

a cam located in the cam chamber, the cam being connected to the rotary shaft;

a piston located in each of the cylinder bores, the piston engaging the cam to reciprocate in accordance with rotation of the rotary shaft through the cam;

a rotary valve including an introducing passage and a supply passage that interconnects the introducing passage and the suction pressure region, the introducing passage introducing fluid from the supply passage into the cylinder bores;

a rotary body including the rotary valve and connected to the rotary shaft; and a communication passage interconnecting the cam chamber and the supply passage the communication passage being formed in the rotary body.

2. A rotary valve for use in a fixed displacement piston type compressor that has a housing including a cam chamber, a cylinder bore, a suction pressure region, and a rotary shaft, the rotary valve comprising:

a supply passage communicating with the suction pressure region;

an introducing passage, communicating with the supply passage for introducing fluid into the cylinder bore, a portion of the fluid leaking into the cam chamber with lubricant; and a communication passage interconnecting the cam chamber and the suction pressure region, a portion of the lubricant in the fluid being separated from the fluid around an opening of the communication passage in the cam chamber and staying in the cam chamber, wherein the rotary valve is integrated with the rotary shaft and the supply passage, the introducing passage and the communication passage are formed in the rotary shaft.

3. The rotary valve according to claim 2, wherein the fixed displacement piston type compressor is a double-headed piston type compressor having a double-headed piston.

4. The rotary valve according to claim 3, wherein the cylinder bore, the introducing passage and the suction pressure region are formed on a front side and a rear side of the compressor, respectively.

5. The rotary valve according to claim 2, wherein the communication passage includes at least the part of supply passage and a communication hole that is formed in a circumferential surface of the rotary shaft.

6. The rotary valve according to claim 5, wherein the communication hole extends substantially in a radial direction of the rotary shaft.

7. The rotary valve according to claim 2, wherein the communication passage includes at least the part of supply passage and a communication hole that extends substantially in an axial direction of the rotary shaft.

8. The rotary valve according to claim 2, further comprising:

a thrust bearing located between the housing and the cam for regulating a position of the cam in an axial direction of the rotary shaft, an opening of the communication passage in the cam chamber being located near the thrust bearing.

9. The rotary valve according to claim 8, wherein the piston is a double-headed piston that is located in a pair of the cylinder bores, the thrust bearing being located on each side of the cam between the housing and the cam so as to sandwich the cam for regulating a position of the cam in the axial direction of the rotary shaft, the opening of the communication passage in the cam chamber being at least located near one of the thrust bearings.

10. The rotary valve according to claim 9, wherein the opening of the communication passage is located near each of the thrust bearings.

11. The rotary valve according to claim 2, wherein the cam chamber communicates with the suction pressure region only through the communication passage.

12. The rotary valve according to claim 2, wherein the cam includes a swash plate.

13. A fixed displacement double-headed piston type compressor comprising:

a housing defining a cam chamber, a plurality of cylinder bores and a suction pressure region;

a rotary shaft rotatably supported by the housing;

a cam located in the cam chamber, the cam being connected to the rotary shaft;

a double-headed piston located in each of the cylinder bores, the piston engaging the cam to reciprocate in accordance with rotation of the rotary shaft through the cam;

a rotary valve including:

a supply passage communicating with the suction pressure region; and an introducing passage communicating with the supply passage for introducing fluid into the cylinder bore, a portion of the fluid leaking into the cam chamber with lubricant, wherein the cylinder bores and the introducing passage are formed on both a front side and a rear side of the compressor; and a rotary body including the rotary valve, the rotary body connected to the rotary shaft, the rotary body further including a communication passage that interconnects the cam chamber and the suction pressure region, a portion of the lubricant in the fluid being separated from the fluid around an opening of the communication passage in the cam chamber and staying in the cam chamber.

14. The fixed displacement double-headed piston type compressor according to claim 13, wherein the rotary body is integrated with the rotary shaft.

15. The fixed displacement double-headed piston type compressor according to claim 13, wherein the rotary valve is integrated with the rotary shaft.

16. The fixed displacement double-headed piston type compressor according to claim 13, wherein the suction pressure region is formed on the front side and the rear side of the compressor, respectively.

17. A fixed displacement double-headed piston type compressor comprising:

a housing defining a cain chamber, a plurality of cylinder bores and a suction pressure region;

a rotary shaft rotatably supported by the housing, the rotary shaft including a communication passage that interconnects the cam chamber and the suction pressure region;

a cam located in the cam chamber, the cam being connected to the rotary shaft;

a double-headed piston located in each of the cylinder bores, the piston engaging the cam to reciprocate in accordance with rotation of the rotary shaft through the cam;

a rotary valve formed integrally with the rotary shaft, the rotary valve including:

a supply passage communicating with the suction pressure region; and an introducing passage communicating with the supply passage for introducing fluid into the cylinder bore, a portion of the fluid leaking into the cam chamber with lubricant, a portion of the lubricant in the fluid being separated from the fluid around an opening of the communication passage in the cam chamber and staying in the cam chamber, wherein the cylinder bores and the introducing passage are formed on a front side and a rear side of the compressor, respectively, the supply passage being also formed in the rotary shaft.

18. The fixed displacement double-headed piston type compressor according to claim 17, wherein the suction pressure region is formed on the front side and the rear side of the compressor, respectively.

19. The fixed displacement double-headed piston type compressor according to claim 17, further comprising:

a thrust bearing located between the housing and the cam for regulating a position of the cam in an axial direction of the rotary shaft, an opening of the communication passage being at least located near the thrust bearing.

20. The fixed displacement double-headed piston type compressor according to claim 19, wherein the piston is a double-headed piston that is located in a pair of the cylinder bores, the thrust bearing being located on each side of the cam between the housing and the cam so as to sandwich the cam for regulating a position of the cam in the axial direction of the rotary shaft, the opening of the communication passage in the cam chamber being at least located near one of the thrust bearings.

* * * * *

UNITED STATES PATENT AND TRADEMARK OFFICE

CERTIFICATE OF CORRECTION

PATENT NO. : 6,988,875 B2
APPLICATION NO. : 10/310525
DATED : January 24, 2006
INVENTOR(S) : Noriyuki Shintoku et al.

It is certified that error appears in the above-identified patent and that said Letters Patent is hereby corrected as shown below:

In the References Cited, Item 56 in the Cover Page

Please add the following under U.S. Patent Documents:

| | | | |
|---|---|---|---|
| 5,549,453 | 8/1996 | Murakami et al. | 417/269 |
| 5,626,463 | 5/1997 | Kimura et al. | 417/269 |
| 5,730,249 | 3/1998 | Shimizu | 184/6.17 |
| 6,224,349 | 5/2001 | Iwanami et al. | 417/269 |

Signed and Sealed this

Twenty-fifth Day of March, 2008

JON W. DUDAS
*Director of the United States Patent and Trademark Office*